US009016924B2

(12) United States Patent
Betsuda

(10) Patent No.: US 9,016,924 B2
(45) Date of Patent: Apr. 28, 2015

(54) LAMP DEVICE

(75) Inventor: Nobuhiko Betsuda, Yokohama (JP)

(73) Assignee: Toshiba Lighting & Technology Corporation, Yokosuka-shi, Kanagawa-ken (JP)

( * ) Notice: Subject to any disclaimer, the term of this patent is extended or adjusted under 35 U.S.C. 154(b) by 165 days.

(21) Appl. No.: 13/595,457

(22) Filed: Aug. 27, 2012

(65) Prior Publication Data

US 2012/0320563 A1 Dec. 20, 2012

Related U.S. Application Data

(63) Continuation of application No. 12/579,864, filed on Oct. 15, 2009, now abandoned.

(30) Foreign Application Priority Data

Oct. 20, 2008 (JP) ..... 2008-269577

(51) Int. Cl.

| | |
|---|---|
| ***H01R 33/00*** | (2006.01) |
| ***F21K 99/00*** | (2010.01) |
| ***F21V 23/00*** | (2006.01) |
| *F21V 3/00* | (2006.01) |
| *F21Y 101/02* | (2006.01) |
| *F21V 19/00* | (2006.01) |

(52) U.S. Cl.

CPC . *F21K 9/135* (2013.01); *F21V 3/00* (2013.01); *F21Y 2101/02* (2013.01); *F21V 23/002* (2013.01); *F21V 19/003* (2013.01)

(58) Field of Classification Search

CPC ..... F21K 9/135
USPC ..... 362/230, 231, 235, 650, 351, 84, 362/249.02, 646, 647, 649

See application file for complete search history.

(56) References Cited

U.S. PATENT DOCUMENTS

| | | | | |
|---|---|---|---|---|
| 5,577,832 | A | 11/1996 | Lodhie | |
| 7,066,623 | B2 * | 6/2006 | Lee et al. | 362/231 |
| 7,784,969 | B2 | 8/2010 | Reisenauer et al. | |
| 2006/0227558 | A1 | 10/2006 | Osawa et al. | |
| 2008/0037255 | A1 | 2/2008 | Wang | |
| 2008/0080187 | A1 | 4/2008 | Purinton | |
| 2008/0316741 | A1 * | 12/2008 | Lee | 362/231 |

FOREIGN PATENT DOCUMENTS

| | | | |
|---|---|---|---|
| JP | 2002-304902 | A | 10/2002 |
| JP | 2003059330 | A | 2/2003 |

(Continued)

OTHER PUBLICATIONS

Notification of Reasons for Refusal issued in corresponding Japanese Patent Application No. 2008-269577 dated Aug. 10, 2012.

*Primary Examiner* — Anh Mai
*Assistant Examiner* — Jessica M Apenteng
(74) *Attorney, Agent, or Firm* — Banner & Witcoff, Ltd.

(57) ABSTRACT

According to some aspects, a light-emitting module that is small and easy to produce may be provided. On the surface of a board, a light-emitting element and an electrical connection portion electrically connected to the light-emitting element are provided. In some examples, in a position close to the electrical connection portion of the board, a through-hole that penetrates the board is formed. Through the through-hole of the board, an electric wire for supplying electric power to the light-emitting element may be inserted from the back surface of the board to the front surface to be electrically connected to the electrical connection portion.

8 Claims, 3 Drawing Sheets

(56) References Cited

FOREIGN PATENT DOCUMENTS

| | | | |
|---|---|---|---|
| JP | 2004-200207 | A | 7/2004 |
| JP | 2006-313717 | A | 11/2006 |
| JP | 2008103112 | A | 5/2008 |

* cited by examiner

LAMP DEVICE

CROSS-REFERENCE TO RELATED APPLICATIONS

The present application is a continuation of and claims priority to U.S. patent application Ser. No. 12/579,864 filed Oct. 19, 2009 entitled "Light-Emitting Module and Illumination Device" and also claims priority under 35 U.S.C. §119 to Japanese Patent Application No. 2008-269577 filed on Oct. 20, 2008. The contents of these applications are incorporated herein by reference in their entirety.

TECHNICAL FIELD

Aspects described herein relate to a light-emitting module having a light-emitting element as a light source and an illumination device using such a light-emitting module.

BACKGROUND

In recent years, instead of a filament self-ballasted lamp, a self-ballasted illumination device and an illumination apparatus that use a light-emitting module having, as a light source, a light-emitting diode that has a long life and low power consumption have been available on the market. In order to provide the light-emitting module having, as alight source, this type of light-emitting diode, it is necessary not only to utilize the advantage of a light-emitting diode to reduce the size but also to improve the productivity for mass production.

For example, a light-emitting module may be a substantially flat-plate-like light-emitting module incorporating a plurality of light-emitting diodes is provided with a terminal block for directly connecting a power supply wire to the light-emitting module and thus a small size and a small thickness that are the advantage of the light-emitting diode are maintained, and in which it is easy to connect the wire.

Moreover, in other examples, a LED light self-ballasted lamp may be provided with: a light-emitting diode provided on the outer surface of a base body; an operating circuit for supplying electric power to the light-emitting diode; and a cover in which the operating circuit is accommodated and in which a base is fitted to one side of the cover and the base end portion of the base body is attached to the other side. In the self-ballasted LED lamp, a lead-in wire of the light-emitting diode is wired and connected to the operating circuit at the leading end portion and the base end portion of the base body, and the wiring is simple and easy to produce.

However, in an example light-emitting module, a power supply wire to the light-emitting diode is wired to a terminal block provided from the outside of a board to the surface thereof. Thus, the power supply wire protrudes outward from the perimeter of the board, and, when the light-emitting module is fitted to the main body of an apparatus, in order to provide an electrically insulting distance to the main body of the apparatus, it is inevitably necessary to increase the outer diameter of the main body of the apparatus. This makes it impossible to reduce the size of the main body of the apparatus.

Although some examples provide that the power supply wire may be connected from the back surface of the board, since, when the power supply wire is connected to the back surface of the board, it is difficult to perform the wiring connection after the board is installed in the main body of the apparatus, it is necessary to previously connect the power supply wire to the back surface of the board. Then, since the board to which the power supply wire is connected is installed in the main body of the apparatus, for example, when the board is fixed to the main body of the apparatus, an external force is applied to the connection portion of the power supply wire, with the result that the power supply wire may be broken or the power supply wire may be disconnected from a rapid connection terminal or the like of the terminal block. Therefore, the light-emitting module is disadvantageously not suitable for mass production.

With some existing self-ballasted LED lamps, since the output line of the operating circuit is connected to the wiring pattern of the light-emitting diode at the leading end portion and the base end portion of the base body, it is possible to make the wiring of the output line simple and easily perform the wiring connection. However, this self-ballasted LED lamp is one in which an LED is provided on the outer surface of the cylindrical base body, and the wiring connection of the power supply wire on the light-emitting module where a light-emitting diode is mounted on the surface of the board in the shape of a flat-plate-like circular plate or the like, which is adopted to facilitate further reduction in size, is not disclosed.

For this reason, with respect to this type of light-emitting module, how a light-emitting module that reduces its size and that facilitates the wiring of a power supply wire and its production is provided is an important problem.

In view of the foregoing problem, aspects described herein are designed to provide a light-emitting module that reduces its size and that facilitates its production and an illumination device.

BRIEF DESCRIPTION OF THE DRAWINGS

FIG. 1(*a*) is a cross-sectional view, and FIG. 1(*b*) is a top view;

DETAILED DESCRIPTION

Figure 1A:
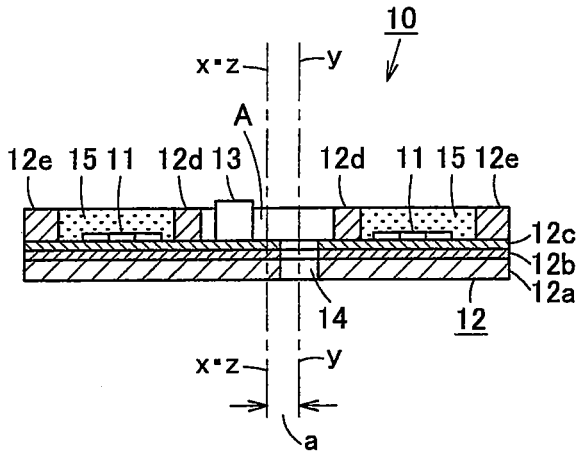
FIGS. 1(*a*) and 1(*b*) show a light-emitting module according to an embodiment of the present invention.

According to aspects described herein, a light-emitting module may include: a light-emitting element; a board having the light-emitting element provided on a front surface of the board; an electrical connection portion provided on the front surface of the board and electrically connected to the light-emitting element; and a through-hole which is formed to penetrate the board in a position close to the electrical connection portion of the board and through which an electrical wire for supplying electric power to the light-emitting element is inserted from a back surface of the board to the front surface thereof and is connected to the electrical connection portion.

In some aspects of a light-emitting module, with the board having the light-emitting element provided on the front surface thereof, it is possible to reduce the size of the light-emitting module. With the through-hole formed to penetrate the board in a position close to the electrical connection portion of the board, it is possible to insert the electrical wire for supplying electric power to the light-emitting element from the back surface of the board to the front surface thereof to connect it to the electrical connection portion. This makes it possible to facilitate the wiring operation and provide the light-emitting module that is easy to produce.

A light-emitting element may have, as a light source, a semiconductor such as a light-emitting diode, an organic EL or a semiconductor laser is permissible. A plurality of light-emitting elements may be used, and the necessary number of light-emitting elements is selected according to the application of illumination, for example, one light-emitting element may only be used.

The board is a member that is used for disposing, as a light source, the light-emitting element on the surface thereof. Preferably, the board is formed with a metal having a satisfactory heat conductivity, such as aluminum, copper or stainless steel, a wiring pattern is formed on the surface via an electrically insulating layer of silicone resin or the like and the light-emitting element is mounted on the wiring pattern; however, there is no restriction on means for, for example, forming and mounting the board. The board may be formed of, for example, synthetic resin such as epoxy resin, glass epoxy or paper phenol. In order to configure a point-like or sheet-like module, the board may be shaped to be, for example, disc-like, polygonal such as quadrangular or hexagonal or elliptical; in order to configure a linear module, the board may be shaped to be long and linear; and, in order to obtain the desired light distribution properties, any shape is permissible.

The electrical connection portion may be configured for electrically connecting the electrical wire for supplying electric power to the light-emitting element provided on the surface of the board. The connection to the light-emitting element may be achieved with a connector that is removably connected to the wiring pattern formed on the board, or the wire may be directly connected to the wiring pattern with means such as soldering or screwing. Without the need for using the wiring pattern, the wire may be directly connected to the light-emitting element.

In order to supply electric power to the light-emitting element provided on the surface of the board, the through-hole formed in the board is used to, for example, insert and pull out the wire connected to the output terminal of the operating circuit from the back surface of the board to the front surface; in order to bend the wire pulled out toward the front surface of the board to connect it to the electrical connection portion, the through-hole is formed so as to penetrate the board; and the shape of the hole is not particularly limited, and any shape such as circular and rectangular may be adopted.

Although the through-hole is formed in a position close to the electrical connection portion, in order to prevent uneven light distribution resulting from the center portion of the non-light-emitting portion including the through-hole and the electrical connection portion being displaced from the center (an optical axis) of the board, it is preferable to place the center of the through-hole slightly away from the center of the board. However, the through-hole may be formed in the center portion of the board or may be formed in the outer circumferential portion or other portion of the board.

According to some aspects, a light-emitting module may include a through-hole formed in a position displaced from the center of the board, in the outer circumferential direction of the board, the electrical connection portion is provided in a position displaced, from the center of the board, in the outer circumferential direction of the board opposite from a direction in which the through-hole is provided, the through-hole and the electrical connection portion constitute a non-light-emitting portion, the center portion of the non-light-emitting portion is positioned at the approximate center of the board and a plurality of the light-emitting elements are provided around the non-light-emitting portion.

Additionally or alternatively, the through-hole and the electrical connection portion may constitute the non-light-emitting portion, the center portion of the non-light-emitting portion is positioned at the approximate center of the board and a plurality of the light-emitting elements are provided around the non-light-emitting portion, with the result that the light-emitting module having constant light distribution performance can be configured.

In some examples of a light-emitting module, the board includes a board main body formed of metal, an electrically insulating layer formed on the front surface of the board main body and a wiring layer formed on the electrically insulating layer, and the light-emitting element and the electrical connection portion are electrically connected to the wiring layer.

For example, in a typical multi-layer board or double-sided board, it is possible to form a through-hole, an electrically conducting path that penetrates the board from the front surface to the back surface to directly provide a connector (pin-type) or the like on the back surface of the board and to achieve the electrical connection of a wire for supplying electric power on the back surface of the board. However, in a board using a board main body formed of metal, such as the board of the present invention, a through-hole, that is, an electrically conducting path that penetrates the board from the front surface to the back surface, cannot be formed, and thus it is difficult to perform the electrical connection of the electrical wire on the back surface of the board.

To overcome the foregoing disadvantage, in the board using the board main body formed of metal, in order to achieve the electrical connection between the wiring layer on the front surface of the board and the electrical wire, as described herein, it is appropriate for safety and the simplification of the structure to form a through-hole through which the electrical wire can be inserted from the back surface of the board to the front surface.

The board main body may be formed of, for example, aluminum, copper or stainless steel as long as it is a metal that has a satisfactory heat conductivity.

The light-emitting element and the electrical connection portion may be disposed and connected on and to the wiring layer of the board, if they are electrically connected to the wiring layer, they may not need to be disposed on the wiring layer.

According to another aspect, there is provided an illumination device including: the light-emitting module; a main body supporting the light-emitting module; and an operating circuit for supplying electric power to the lighting-emitting module.

Accordingly, it is possible to provide an illumination device that is small and easy to produce.

The illumination device may be formed with, for example, a self-ballasted illumination device. The self-ballasted illumination device may be provided with a globe that covers a semiconductor light-emitting module or may be a globe-less self-ballasted illumination device without the need for a globe.

Although the main body is preferably formed of a metal such as aluminum, copper or stainless steel having satisfactory heat conductivity, it may be formed of synthetic resin having heat resistance, light resistance and electrical insulation, such as polybutylene terephthalate (PBT).

An embodiment of a light-emitting module, an illumination device incorporating this light-emitting module and an illumination apparatus incorporating this illumination device will be described below with reference to the accompanying drawings.

The configuration of the light-emitting module will first be described.

Figure 1B:
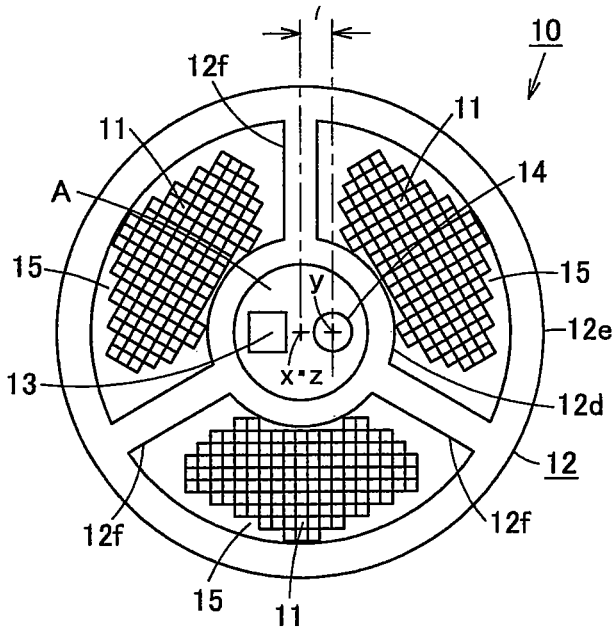

As shown in FIGS. 1(*a*) and 1(*b*), the light-emitting module 10 is composed of light-emitting elements 11 serving as a light source, a board 12 on which the light-emitting elements 11 are provided on the surface thereof, an electrical connection portion 13 provided on the surface of the board 12 and a through-hole 14 formed to penetrate the board 12.

In this example, the light-emitting elements 11 are formed with light-emitting diodes (hereinafter, referred to as "LEDs 11") that are semiconductor light-emitting elements; a plurality of LEDs 11 having the same function are used. In this example, each LED 11 is composed of a blue LED chip and a yellow fluorescent substance that is excited by this blue LED chip, and emits white light of high brightness and achieves high output.

The board 12 has a board main body 12*a* formed of, in this example, high thermal conductive aluminum in the shape of a flat-plate-like substantially circular plate; on the surface (the upper surface shown in FIG. 1(*a*)) of the board main body 12*a*, an electrically insulating layer 12*b* of silicone resin or the like is formed; on this electrically insulating layer 12*b*, a wiring pattern 12*c* of copper foil serving as a wiring layer is formed; and, on the wiring pattern 12*c*, the LEDs 11 are mounted. Specifically, a plurality of LEDs 11 are substantially regularly spaced such that they are substantially concentrically arranged about the center "x" of the circular-plate-like board 12. The LEDs 11 are connected in series with each other by the wiring pattern 12*c*.

In the board 12, the through-hole 14 is formed that penetrates the board main body 12*a*, the electrically insulating layer 12*b* and the wiring pattern 12*c*. The through-hole 14 is a penetrating hole through which a wire "w" for supplying power to the LEDs 11 is inserted from the back surface of the board 12 to the surface thereof and is connected to the electrical connection portion 13, and is formed such that its center "y" is located a distance "a" away from the center "x" of the board 12 in a circumferential direction of the board 12. Around the through-hole 14, a convex ring frame 12*d* is formed with a space left, and, in an outer circumferential portion surrounding the LEDs 11 mounted on the surface of the board 12, a similar convex ring frame 12*e* is formed. These double convex ring frames 12*d* and 12*e* are integrally formed by three ribs 12*f* that are regularly spaced at an angle of 120.degree. apart from each other about the center "x" of the board 12 with respect to a radial direction, that is, in an outer circumferential direction. The double convex ring frames 12*d* and 12*e* and the ribs 12*f* are equal in height to each other; for example, the height preferably ranges from 0.1 mm to 2.0 mm.

The double convex frames 12*d* and 12*e* and the three ribs 12*f* formed on the surface of the board 12 are formed as follows. Specifically, by being molded of synthetic resin, in this example, epoxy resin, the three ribs 12*f* are integrally formed between the double ring frames 12*d* and 12*e* having different radii. These molded frames 12*d* and 12*e* with the ribs are disposed around the through-hole 14 and in the predetermined outer circumferential portion surrounding the LEDs 11, and are fixed on the surface of the board 12 with an adhesive formed of silicone resin, epoxy resin and the like having electrical insulation and heat resistance properties.

In this case, since the double ring frames 12*d* and 12*e* are formed integrally with the ribs 12*f*, it is possible to place the double ring frames 12*d* and 12*e* in a predetermined position in a single step. When the ribs 12*f* are not formed integrally therewith, two steps are required, one for placing the inner frame 12*d* and the other for placing the outer frame 12*e*.

The ribs 12*f* coupled with the convex frames 12*d* and 12*e* and these frames 12*d* and 12*e* form dams that are closed in the shape of a sector. The wiring pattern 12*c* is provided within a sector-shaped space enclosed by the dams, and, on the wiring pattern 12*c*, the LEDs 11, in this example, a plurality of blue LED chips are mounted and provided. Moreover, a transparent member 15 containing a yellow fluorescent substance is applied or filled so as to cover the blue LED chips, with the result that the LEDs 11 are sealed on the surface of the board 12.

In this case, since the dams that are closed in the shape of a sector are formed by the convex frames 12*d* and 12*e* and the ribs 12*f* coupled with the frames 12*d* and 12*e*, when the transparent member 15 is applied or filled, liquid sealing resin constituting the transparent member 15 is prevented from flowing into the outer circumferential portion of the board 12 and the through-hole 14, and the sealing resin is prevented from adhering to unnecessary portions or the like of the back surface of the board 12 that communicate with the front surface of the board 12 and the through-hole 14. In this example, the transparent member 15 is a layer that is formed by mixing and distributing a predetermined yellow fluorescent substance with a transparent resin such as silicon resin and epoxy resin.

Figure 4:
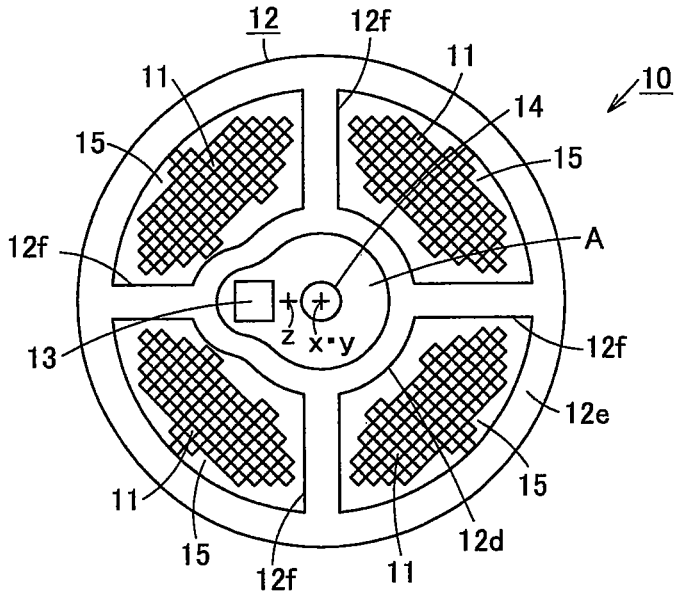
FIG. 4 is a plan view showing a variation of the light-emitting module.

The through-hole 14 is formed in a position close to the electrical connection portion 13. Specifically, the electrical connection portion 13 is formed in a position displaced in an outer circumferential direction of the board 12, that is, in a radial direction opposite from a direction from the center "x" of the board 12 to the through-hole 14. As shown in FIG. 1(*b*), the through-hole 14, the electrical connection portion 13 and the convex frame 12*d* formed around them constitute a non-light-emitting portion A. Specifically, the center portion "z" of the non-light-emitting portion A including the through-hole 14 formed the distance "a" away from the center "x" of the board 12 and the electrical connection portion 13 formed close to the through-hole 14 is placed to coincide with the center "x" of the board 12; a plurality of LEDs 11 are formed around the non-light-emitting portion A. If the center "y" of the through-hole 14 is formed at the center "x" of the board 12, as shown in FIG. 4, the electrical connection portion 13 is inevitably provided in a position further displaced in the outer circumferential direction from the center "x" of the board 12, and thus the center "z" of the non-light-emitting portion A is provided in a position displaced in the outer circumferential direction of the board 12. As a result of this, the shadow of the electrical connection portion 13 slightly displaced is projected, in a displaced manner, on the top portion of a globe 24 which will be described later, and the distribution of light is displaced and the light is unevenly distributed. In order to prevent this, according to the present invention, by substantially placing the center portion "z" of the non-light-emitting portion A at the center "x" of the board 12, that is, by substantially placing the center portion "z" of the non-light-emitting portion A at the center "x" of the top portion of the globe 24, it is possible to evenly distribute the shadow over the entire area around the center of the top portion and to light the entire globe 24 substantially evenly, with the result that the light can be evenly distributed. As shown in FIG. 4, the electrical connection portion 13 is provided in the position further displaced from the center "x" of the board 12 in the outer circumferential direction, and thus the dams closed in the shape of a sector where the LEDs 11 are mounted are deformed to protrude in one direction, with the result that its light-emitting surface is different in shape from other light-emitting surfaces in the shape of a sector. The different shapes result in the number of LEDs 11 used being different. Therefore, the light-emitting surfaces of different brightness are formed, and thus the light as a whole may be displaced and unevenly distributed.

The electrical connection portion 13 is formed with a small connector, and the output side terminal of the connector is connected and fixed to the introduction side of the wiring pattern 12*c* in which the LEDs 11 are wired in series, and is electrically connected through the wiring pattern 12*c* to the LEDs 11 provided on the surface of the board 12. The power supply wire "w" connected to the output terminal of an operating circuit 22 which will be described later is connected to the input side terminal of the connector. In this way, the entire appearance shape is formed in the approximate shape of a disc, and a small light-emitting module 10 whose board 12 is flat-plate shaped is configured.

The configuration of the illumination device using the light-emitting module 10 configured in this way will now be described.

Figure 2:
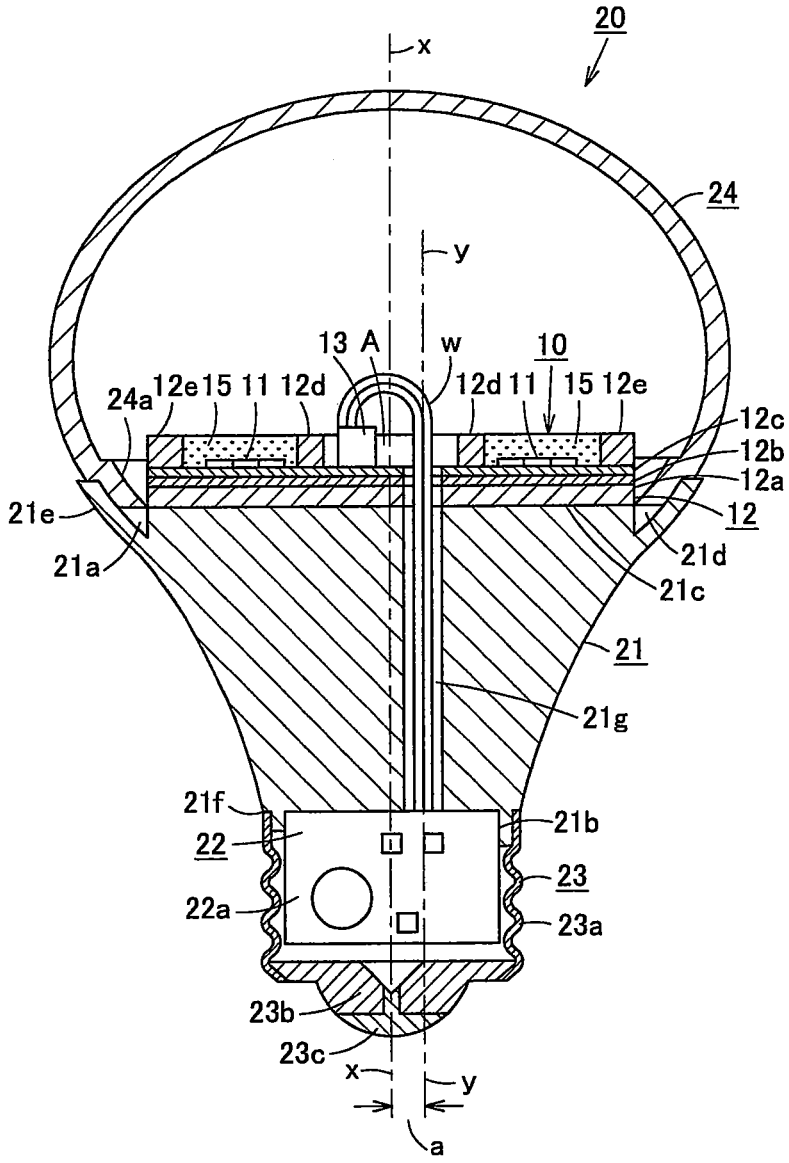
FIG. 2 is a vertical cross-sectional view of an illumination device incorporating the light-emitting module.

As shown in FIG. 2, the illumination device of this example is formed with a self-ballasted illumination device; this self-ballasted illumination device 20 is composed of the light-emitting module 10, a main body 21 supporting the light-emitting module 10, the operating circuit 22 lighting the light-emitting module 10, a base 23 for supplying power to the operating circuit 22 and the globe 24 covering the light-emitting module 10.

The main body 21 is formed of a metal having a satisfactory heat conductivity, in this example, aluminum, and an opening portion 21*a* having a large diameter is formed in an upper end portion and an opening portion 21*b* having a small diameter is formed in a lower end portion, in such a way that they are integrally formed; the appearance of the main body 21 is configured in the approximate shape of a silhouette of a neck portion of an incandescent self-ballasted lamp such that an outer circumferential surface is formed as a substantially cone-shaped tapered surface whose diameter is gradually decreased from top to bottom. The main body 21 is formed by, for example, casting, forging, cutting or the like.

In the opening portion 21*a* in the upper end portion of the main body 21, a circular stand-like supporting portion 21*c* whose surface is formed to be smooth is integrally formed, around the supporting portion 21*c*, a ring-shaped groove 21*d* is formed, and a flange portion 21*e* is integrally formed that protrudes obliquely outward of the groove 21*d*. In the outer circumferential portion of the opening portion 21*b* of the lower end portion of the main body 21, a step-like base attachment portion 21*f* is integrally formed. Moreover, an insertion communication hole 21*g* is formed that penetrates, along the x-x direction of a central axis line, from the center portion of the supporting portion 21*c* to the opening portion 21*b* of the lower end portion. This insertion communication hole 21*g* is formed in a position where the central axis line y-y of the through-hole 14 is displaced by only the distance "a" from the central axis line x-x of the main body 21 in the outer circumferential direction such that the insertion communication hole 21*g* communicates with the through-hole 14 which is formed on the board 12. The power supply wire "w" is inserted through the through-hole 14.

The operating circuit 22 is formed with a flat-plate-like circuit board 22*a* on which circuit components constituting a lighting circuit of the LEDs 11 are mounted. In the circuit board 22*a*, in a vertical direction, its upper end portion is fixed to the inside of the opening portion 21*b* in the lower end portion of the main body 21 with an adhesive formed of silicone resin, epoxy resin and the like to achieve electrical insulation with the main body 21, and its lower end portion is likewise fixed to the inside of the base 23 with an adhesive formed of silicone resin, epoxy resin and the like, and thus achieves electrical insulation with the base 23 to be accommodated. The lighting circuit is configured to convert, for example, an alternating-current voltage of 100 volts into a direct-current voltage of 24 volts to supply it to the LEDs 11. The power supply wire "w" is connected to the output terminal of the circuit board 22*a*; an input wire (not shown) is connected to the input terminal. These power supply wire "w" and input wire are electrically insulated.

The base 23 is an Edison type of E 17 type or the like, and is provided with a cylindrical shell portion 23*a* having screw threads and an eyelet portion 23*c* that is provided, via an insulating portion 23*b*, on the top portion of the lower end of the shell portion 23*a*. The opening portion of the shell portion 23*a* is fitted, via an adhesive such as silicone resin, epoxy resin and the like, an electrically insulating sheet or the like, into the base attachment portion 21*f* of the main body 21, and is insulated and fixed to the main body 21 by adhesion, swaging or the like. An input line introduced through the input terminal of the circuit board 22*a* is connected to the shell portion 23*a* and the eyelet portion 23*c* of the base 23.

The globe 24 is transparent, is formed of, for example, thin glass or synthetic resin and has a milky white color that provides transparency or light diffusion properties. The globe 24 is formed to have a smooth curved surface in the approximate shape of a silhouette of a spherical portion of an incandescent self-ballasted lamp having an opening 24*a* at one end. The globe 24 fits the opening end portion of the opening 24*a* into the groove 21*d* formed around the supporting portion 21*c* of the main body 21 so as to cover the light-emitting surface of the board 12, and is fixed with an adhesive such as silicone resin or epoxy resin. In this way, the flange portion 21*e* inclined outward of the main body 21 has an appearance shape that is substantially continuous integrally with the outer circumferential surface of the globe 24, and is configured in the approximate shape of a silhouette of a spherical portion of a common incandescent self-ballasted lamp.

The assembly procedure of the self-ballasted illumination device 20 will now be described.

First, the wire "w" connected to the output terminal of the circuit board 22*a* constituting the operating circuit 22 is inserted through the insertion communication hole 21*g* of the main body 21, and the leading end portion thereof is pulled through the insertion communication hole 21*g*.

Then, the input line introduced through the input terminal of the circuit board 22*a* is connected to the shell portion 23*a* and the eyelet portion 23*c* of the base 23, and, with the input line connected, the upper end portion of the circuit board 22*a* is fixed to the inside of the opening portion 21*b* of the main body 21 in a vertical direction with adhesive, and the lower end portion of the circuit board 22*a* is accommodated within the base 23. With the lower end portion accommodated, the opening portion of the shell portion 23*a* is fitted and fixed to the base attachment portion 21*f* of the main body 21 via adhesive.

Then, the light-emitting module 10 is prepared, and the wire "w" pulled from the insertion communication hole 21*g* of the main body 21 is first inserted through the back surface of the board 12 into the through-hole 14 and is pulled to the front surface of the board 12. The board 12 with the wire "w" pulled out is placed on the supporting portion 21*c* of the main body 21, and is fixed to the main body 21 at about three points of the upper surface (the surface) with fixing means such as screws. In this way, the through-hole 14 of the board 12 matches the insertion communication hole 21*g* of the main body 21, and thus they communicate with each other, and the back surface of the board 12 makes close contact with the smooth surface of the supporting portion 21*c* of the main body 21 such that they are fixed to each other.

Then, the wire "w" pulled out is bent toward the front surface of the board 12 and is connected to the connector serving as the electrical connection portion 13. In this case, since the electrical connection portion 13 is provided on the front surface of the board 12 where the LEDs 11 are provided, it is possible to perform both the operation of connecting the electrical connection portion 13 to the wiring pattern 12*c* and the operation of connecting the power supply wire "w" to the electrical connection portion 13 on the front surface side of the board 12 where the LEDs 11 are exposed to the outside. Moreover, since the board 12 is already fixed to the main body 21, it is unnecessary to perform these wiring connecting operations with the board 12 being not fixed to the main body 21 to be unstably floated.

Then, the opening end portion of the globe 24 is fitted into the groove 21*d* of the main body 21 so as to cover the light-emitting surface of the board 12, and is fixed with adhesive. In this way, the small self-ballasted illumination device 20 is formed that uses the small light-emitting module 10 whose board 12 is flat-plate shaped, whose appearance shape is approximately similar to a silhouette of a common incandescent self-ballasted lamp, and that has a rated lamp power of about 5 W to have a brightness corresponding to 25 W of an incandescent self-ballasted lamp.

The configuration of the illumination apparatus having the self-ballasted illumination device 20 as a light source will now be described.

Figure 3:
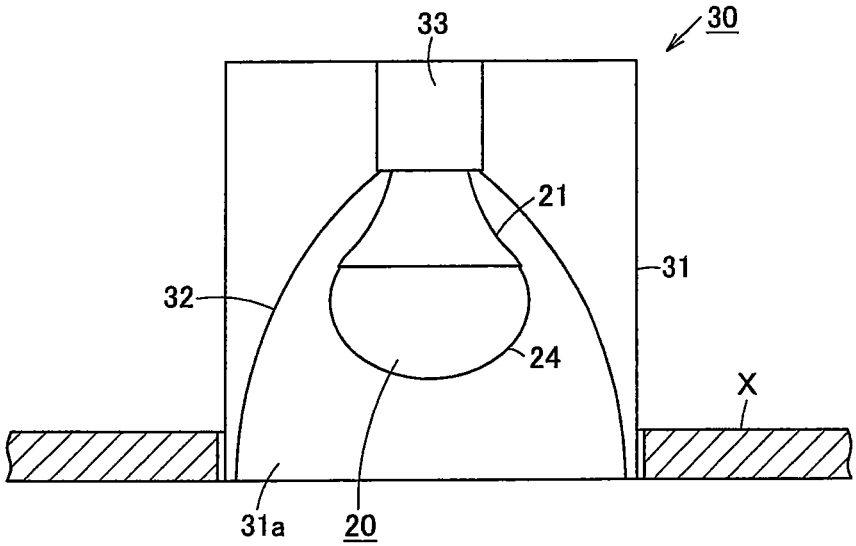
FIG. 3 is a vertical cross-sectional view of an illumination apparatus incorporating the illumination device.

As shown in FIG. 3, the illumination apparatus 30 is installed by being embedded in the ceiling surface X of a shop or the like, and is a downlight-type illumination apparatus having, as a light source, a small incandescent self-ballasted lamp with a base of E 17 type. The illumination apparatus 30 is composed of an apparatus main body 31 that has an opening portion 31*a* in the lower surface thereof and that is formed of metal in the shape of a box, a metallic reflective member 32 disposed within the apparatus main body 31 and a socket 33 into which the base of E 17 type of the incandescent self-ballasted lamp is screwed. The reflective member 32 is formed with a metallic plate of, for example, stainless steel; in the center portion of the upper surface plate of the reflective member 32, the socket 33 is disposed.

In this type of illumination apparatus 30, in order to save energy, instead of the incandescent self-ballasted lamp, it is possible to use the self-ballasted illumination device 20 having the LEDs 11 as a light source. Specifically, since the illumination device 20 has the base 23 of E 17 type, it is possible to directly connect it to the socket 33 of the illumination apparatus 30. In this case, since the appearance is configured in the approximate shape of a silhouette of the neck portion of the incandescent self-ballasted lamp such that the main body 21 of the self-ballasted illumination device 20 has a substantially cone-shaped tapered surface, it is possible to connect the illumination device 20 to the socket 33 without the neck portion of the illumination device 20 being in contact with the reflective member 32 or the like, with the result that the proportion in which the illumination device 20 is applied to the existing illumination apparatus 30 can be improved. In this way, the energy-saving downlight having the LEDs 11 as a light source is provided.

When the power is turned on to the illumination apparatus 30, the power is supplied from the socket 33 through the base 23 of the illumination device 20 to the operating circuit 22, and the operating circuit 22 is operated to output a direct-current voltage of 24 volts. This direct-current voltage is applied to the LEDs 11 connected in series through the power supply wire "w" connected to the output terminal of the operating circuit 22 and the electrical connection portion 13. In this way, the LEDs are lit simultaneously to emit white light.

In this case, since the LEDs 11 are concentrically mounted and substantially regularly spaced on the surface of the flat-plate-like board 12, the light emitted from the LEDs 11 is substantially evenly distributed over the entire inner surface of the globe 24, and, since the main body 21 of the illumination device 20 has an appearance shape that is continuous integrally with the outer circumferential surface of the globe 24, and is configured in the approximate shape of a silhouette of a spherical portion of an incandescent self-ballasted lamp, it is possible to perform an illumination operation having the property of substantially evenly distributing light in all directions equivalent to an incandescent self-ballasted lamp. Furthermore, since the center portion "z" of the non-light-emitting portion A composed of the through-hole 14, the electrical connection portion 13 and the like is provided to be located at the approximate center "x" of the board 12 and a plurality of LEDs 11 are provided around the non-light-emitting portion A, it is possible not only to evenly distribute the shadow of the non-light-emitting portion A over the entire area having the top portion of the globe 24 at its center but also to substantially evenly light the entire globe and to perform an illumination operation of evenly distributing light because a plurality of LEDs 11 are provided around the non-light-emitting portion A.

Simultaneously, since the light distribution of the illumination device 20 is approximate to that of an incandescent self-ballasted lamp and thus the amount of light emitted to the reflective member 32 in the vicinity of the socket 33 disposed within the illumination apparatus 30 is maintained, it is possible to obtain the apparatus property substantially corresponding to the optical design of the reflective member 32 formed for use in an incandescent self-ballasted lamp.

When the illumination device 20 is lit, the LEDs 11 generate heat and thus the temperature is increased. The heat is conducted from the board 12 formed of aluminum through the supporting portion 21*c* of the main body 21 to which the board 12 is firmly fixed, and is dissipated from the main body 21 into the air. In this case, it is possible to achieve the following: since the board 12 and the main body 21 are formed of aluminum having a satisfactory heat conductivity, it is possible to reduce conductivity loss and to effectively dissipate the heat generated in the LEDs 11 from the main body 21; it is possible to prevent the temperature rise and the uneven temperature of the LEDs 11; it is possible to reduce a decrease in light emission efficiency of the LEDs 11; it is possible to prevent a decrease in illumination resulting from the light flux being reduced; and it is possible to simultaneously extend the life of the LEDs 11.

The heat generated from circuit components in the operating circuit 22 is dissipated from the circuit board 22*a* via the main body 21 and the base 23. By the action of the heat dissipation, it is possible to prevent the temperature rise and the uneven temperature of the operating circuit 22, with the result that the reliability of the circuit components can be improved.

As described above, according to this embodiment, the board 12 is a flat-plate-like substantially circular plate, the electrically insulating layer 12*b* and the wiring pattern 12*c* are formed on the surface of the metallic board main body 12*a* and a plurality of LEDs 11 are provided on the wiring pattern. Thus, it is possible to provide a small and thin light-emitting module 10 having the entire substantially disc-like appearance shape.

Since the through-hole 14 penetrating the board 12 is formed in the board 12 and the electrical connection portion 13 is formed on the surface of the board 12, it is possible to insert the wire "w" pulled through the insertion communication hole 21*g* of the main body 21 into the through-hole 14 from the back surface of the board 12, pull it out to the surface of the board 12, bend the wire "w" pulled out toward the surface of the board 12 and connect it to the electrical connection portion 13. Thus, it is possible to perform both the operation of connecting the electrical connection portion 13 to the wiring pattern 12*c* and the operation of connecting the power supply wire "w" to the electrical connection portion 13 on the front surface side of the board 12 where the LEDs 11 are exposed to the outside, with the result that it is possible to facilitate the wiring operation and provide the light-emitting module 10 that is easy to produce and is suitable for mass production. In this way, it is possible to reduce the cost of the illumination device 20 to achieve the low cost of the illumination device 20.

As described above, in order to perform, on the board 12 using the metallic board main body 12*a*, the electrical connection between the wiring pattern on the surface of the board 12 and the wire "w," it is suitable for the safety and the simplification of the structure to form the through-hole 14 through which the wire "w" can be passed from the back surface to the front surface of the board 12.

Since the board 12 is already fixed to the main body 21, it is unnecessary to perform these wiring connecting operations with the board 12 being not fixed to the main body 21 to be unstably floated, with the result that the wiring operations are further facilitated. Unlike the conventional light-emitting module disclosed in Japanese Laid-Open Patent Publication No. 2003-059330, it is unnecessary to install, into the main body, the board to which the power supply wire is connected, and thus it is possible to prevent the wire from being broken or prevent the wire from being disconnected from a rapid connection terminal due to the application of an external force on the wire connection portion. Moreover, since, unlike the conventional light-emitting module disclosed in Japanese Laid-Open Patent Publication No. 2003-059330, the power supply wire "w" does not protrude outward of the board 12, when the light-emitting module 10 is fitted to the opening portion 21*a* of the main body 21 in the illumination device 20, it is unnecessary to provide an electrically insulating distance between the wire "w" and the main body 21, with the result that it is possible to reduce the size of the main body 21.

Since the convex frame 12*d* is formed around the through-hole 14 on the surface of the board 12, the convex frame 12*e* is also formed in the outer circumferential portion surrounding the LEDs 11 mounted on the surface of the board 12 and the dams that are closed in the shape of a sector are formed by coupling the convex frames 12*d* and 12*e* together with the three ribs 12*f*, when the transparent member 15 for sealing the LEDs 11 is applied or filled, liquid sealing resin does not flow into the outer circumferential portion of the board 12 and the through-hole 14, and the sealing resin does not adhere to unnecessary portions or the like in the back surface of the board 12 that communicate with the surface of the board 12 and the through-hole 14. Thus, it is possible to prevent adverse effects resulting from the resin flowing into the high-density wiring pattern 12*c* and the like.

Since the double ring frames 12*d* and 12*e* are integrally formed by the ribs 12*f*, it is possible to place the double ring frames 12*d* and 12*e* in a predetermined position in a single step, with the result that it is possible to simplify the production process and provide the light-emitting module 10 further suitable for mass production. Since the ribs 12*f* have the function of the partitioning dams and the function of integrally forming the double frames 12*d* and 12*e*, it is unnecessary to perform particular processing or the like for simplifying the production process, and this is advantageous in terms of cost.

Since the through-hole 14 of the board 12 is formed such that its center "y" is located a distance "a" away from the center "x" of the board 12 in the circumferential direction of the board 12, and the electrical connection portion 13 is provided in a position displaced in the outer circumferential direction of the board 12 opposite from a direction from the center "x" of the board 12 to the through-hole 14, the center portion "z" of the non-light-emitting portion A composed of the through-hole 14, the electrical connection portion 13 and the like is provided to substantially coincide with the center "x" of the board 12, since a plurality of LEDs 11 are located around the non-light-emitting portion A, it is possible to evenly distribute light.

Although, in this embodiment, the through-hole 14 is formed such that its center "y" is located the distance "a" away from the center "x" of the board 12 in the circumferential direction of the board 12, and the electrical connection portion 13 is provided in the position displaced from the center "x" of the board 12 in the outer circumferential direction of the board 12 opposite from the direction in which the through-hole 14 is provided, as shown in FIG. 4, the through-hole 14 may be formed such that the center "x" of the board 12 coincides with the center "y" of the through-hole 14, and the electrical connection portion 13 may be formed close to the through-hole 14. In this case, although the electrical connection portion 13 is provided in a position displaced from the center "x" of the board 12 in the outer circumferential direction, and the center portion "z" of the non-light-emitting portion A is displaced in the outer circumferential direction of the board 12, it is possible to diffuse and evenly distribute light by use of the globe 24 of a thick milky white color or the like that significantly diffuses light.

Although the through-hole 14 formed in the board 12 is formed as a hole through which the power supply wire "w" is inserted, when the wiring of the wire "w" is performed otherwise, the through-hole 14 may be utilized as a hole for fixing the illumination device 20 of the board 12 to the main body 21.

Although the double ring frames 12*d* and 12*e* formed on the board 12 are integrally configured by the three ribs 12*f*, as shown in FIG. 4, they may be integrally configured by four ribs 12*f* that are provided about the center "x" of the board 12 in a radial direction and that are substantially regularly spaced at an angle of 90° apart with respect to the outer circumferential direction. Without the provision of the outer frame 12*e*, only the inner frame 12*d* may be used.

Although the frames 12*d* and 12*e* and the three ribs 12*f* are formed into the closed dams, the dams may have notches or the like and may be unclosed if they can prevent the resin from flowing out, specifically all the frames and ribs are permissible as long as they can prevent the resin from flowing out. The frames 12*d* and 12*e* and the ribs 12*f* may be formed by moving a dispenser filled with liquid resin on the surface of the board 12 and forming the dams around the through-hole 14 and in the outer circumferential portion; the means for achieving this is not particularly limited. Although the frames 12*d* and 12*e* and the ribs 12*f* are formed such that their heights are substantially equal to each other, the height of either of them may be higher or may be lower.

Although the LEDs 11 provided on the board 12 each are composed of the identical blue LED chips and the yellow fluorescent substance that is excited by the blue LED chips, and thus emit white light, in each of three or four spaces in the shape of a sector surrounded by the frames 12*d* and 12*e* and the ribs 12*f*, an LED chip for emitting the light of a different color and a fluorescent substance may be disposed. This makes it possible to completely separate the transparent member 15 containing the fluorescent substance from the adjacent sector-shaped spaces, and thus it is possible to use the LEDs 11 that do not contain the transparent member 15 and that are separated therefrom, with the result that it is possible to provide the light-emitting module 10 that has color variations such as red color-based, green color-based and blue color-based light emission colors, light bulb colors, daylight white color and daylight color, and that can produce a variety of illumination environments having high color rendering properties, the self-ballasted illumination device 20 and the illumination apparatus 30 incorporating these.

The transparent member 15 that seals the LEDs 11 may be formed of transparent resin that contains no fluorescent substance. As the transparent resin, for example, liquid epoxy resin, liquid silicone resin or the like is permissible. Instead of resin, transparent glass may be used.

In the main body 21 of the self-ballasted illumination device 20, the outer surface portion exposed to the outside, for example, may be formed to have projections and recesses or a pearskin finish to increase its surface area or may be subjected to white coating or white alumite treatment to increase the thermal emissivity of the outer surface portion. Moreover, a large number of radiation fins may be integrally formed to increase the surface area to more effectively dissipate heat. When the white coating or white alumite treatment are undergone, and the self-ballasted illumination device 20 is fitted to the illumination apparatus 30 to light it up, it is possible to increase the reflectivity of the outer surface of the main body 21 exposed to the outside and formed of aluminum to increase the efficiency of the apparatus, and also to provide satisfactory appearance or design to increase its merchantability.

Although the circuit board 22*a* of the operating circuit 22 is provided within the main body 21 in a vertical direction, the circuit board 22*a* that is designed to be smaller may be provided sideways (in a horizontal direction) or provided to be obliquely inclined. A light control circuit may be provided in the operating circuit 22 to perform the light control of the LEDs 11. By individually performing the light control of the LEDs 11, for example, by controlling the output of the LEDs 11 for each compartment space in the shape of a sector, a variety of illumination environments with a large number of variations may be created.

As the self-ballasted illumination device 20, instead of the above-described self-ballasted illumination device 20 designed to be similar to a small incandescent self-ballasted lamp, a reflector-type self-ballasted illumination device, a ball-type self-ballasted illumination device, a cylindrical self-ballasted illumination device or the like may be provided. Although the base 23 is of E 17 type, it may be of another type, for example, E26-shape, or it may be a base other than the Edison type.

Although the downlight used by being embedded in the ceiling is adopted as the illumination apparatus 30, it may be directly attached to a ceiling, hung from a ceiling, attached to a wall surface or installed otherwise; the illumination apparatus 30 may have a globe, a shade, reflector or the like attached to the main body of the apparatus as a light controller; and the illumination apparatus 30 may have the self-ballasted illumination device 20 exposed. The illumination apparatus 30 is not limited to one in which one self-ballasted illumination device 20 is attached to the main body of the apparatus, but it may have a plurality of self-ballasted illumination devices 20 attached thereto. The illumination apparatus 30 is not limited to one for use as a downlight, a spotlight or the like in home, but it may be an illumination apparatus for commercial use in a shop or an office.

Although the preferred embodiment of the present invention is described, the present invention is not limited to the embodiment described above. Various design modifications are possible without departing from the scope of the present invention.

What is claimed is:

1. A lamp device comprising:

a main body having:

a communication hole formed along at least a portion of a central axis line of the main body, and a supporting portion surrounding the communication hole;

a light-emitting module having:

a board fixed on the supporting portion, and one or more light-emitting elements mounted on the board;

at least three transparent members respectively including yellow fluorescent material, the at least three transparent members arranged at equal intervals from one another, wherein the yellow fluorescent material is configured to be excited by light emitted from the one or more light-emitting elements;

an electrical connection portion electrically connected to the one or more light-emitting elements;

an operating circuit mounted on a circuit board and electrically connected to the electrical connection portion and configured to supply electrical power to the lighting-emitting module; and a wire electrically connecting the electrical connection portion and the operating circuit through the communication hole, wherein a first non-light emitting portion is formed at a position surrounded by and radially equidistant from the at least three transparent members, and wherein a central axis of the communication hole is provided so as to pass through a center of the first non-light emitting portion.

2. The lamp device of claim 1, wherein the wire is bent toward the electrical connection portion while extending from the communication hole.

3. The lamp device of claim 1, wherein a second non-light emitting portion is formed between each pair of adjacent transparent members of the at least three transparent members, and the second non-light emitting portion extends in a radial direction.

4. The lamp device of claim 1, wherein the lamp device comprises a plurality of supporting portions, and wherein the lamp device includes one or more protruding portions located between each pair of the plurality of supporting portions.

5. The lamp device of claim 1, wherein the operating circuit is located in the main body.

6. A lamp device comprising:

a main body having:

a communication hole formed along at least a portion of a central axis line of the main body, and a supporting portion surrounding the communication hole;

a light-emitting module having:

a board fixed on the supporting portion, and one or more light-emitting elements mounted on the board;

at least three transparent members respectively including yellow fluorescent materials, the at least three transparent members arranged at equal intervals from one another, wherein the yellow fluorescent material is configured to be excited by light emitted from the one or more the light-emitting elements;

an electrical connection portion electrically connected to the one or more light-emitting element; and an operating circuit mounted on a circuit board and electrically connected to the electrical connection portion and configured to supply electrical power to the light-emitting module, wherein a non-light-emitting portion is formed at a position surrounded by and radially equidistant from the at least three transparent members, wherein the electrical connection is provided at the non-light-emitting portion, wherein a central axis of the communication hole is provided so as to pass through a center of the non-light-emitting portion, and wherein each of the at least three transparent members is separated from a respective other one of the at least three transparent members by a respective rib of a plurality of ribs.

7. A lamp comprising:

a main body having:

a communication hole formed along at least a portion of a central axis line of the main body, and a supporting portion surrounding the communication hole;

a light-emitting module having:

a board fixed on the supporting portion, and one or more light-emitting elements mounted on the board;

at least three transparent members respectively including yellow fluorescent materials, the at least three transparent members arranged at equal intervals from one another, wherein the yellow fluorescent material is configured to be excited by light emitted from the one or more the light-emitting elements;

an electrical connection portion electrically connected to the one or more light-emitting element; and an operating circuit mounted on a circuit board and electrically connected to the electrical connection portion and configured to supply electrical power to the light-emitting module, wherein a non-light-emitting portion is formed at a position surrounded by and radially equidistant from the at least three transparent members, wherein the electrical connection is provided at the non-light-emitting portion, wherein a central axis of the communication hole is provided so as to pass through a center of the non-light-emitting portion, wherein each of the at least three transparent members is separated from a respective other one of the at least three transparent members by a respective rib of a plurality of ribs, and wherein the non-light-emitting portion is separated from the light-emitting elements by a frame member configuring an outer edge of the non-light-emitting portion, the frame member formed integrally with the ribs.

8. The lamp device of claim 7, wherein the frame member extends in a direction perpendicular to a surface of the non-light-emitting portion.

* * * * *